US006701819B1

(12) United States Patent
Williams et al.

(10) Patent No.: US 6,701,819 B1
(45) Date of Patent: Mar. 9, 2004

(54) APPARATUS FOR LAUNCHING AN OBJECT IN A FLUID ENVIRONMENT

(75) Inventors: Michael W. Williams, Portsmouth, RI (US); Paul E. Moody, Barrington, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/224,229

(22) Filed: Aug. 19, 2002

(51) Int. Cl.[7] ..... F41F 3/07; F41F 3/10

(52) U.S. Cl. ..... 89/1.81; 89/1.817; 114/257; 114/316; 114/320; 114/238

(58) Field of Search ..... 89/1.809, 1.8, 89/1.817, 1.818; 114/257, 316, 317, 318, 319, 238, 239, 320

(56) References Cited

U.S. PATENT DOCUMENTS

| | | | | |
|---|---|---|---|---|
| 1,526,256 A | * | 2/1925 | Techel | |
| 3,279,319 A | * | 10/1966 | Semonian et al. | 89/1.81 |
| 4,854,260 A | * | 8/1989 | Woidich et al. | 114/316 |
| 5,495,819 A | * | 3/1996 | Marion | 114/238 |

FOREIGN PATENT DOCUMENTS

| | | | | |
|---|---|---|---|---|
| BE | 745.797 | * | 7/1970 | 89/1.817 |
| DE | 33 33 614 A1 | * | 4/1985 | |
| DE | 37 37 090 A1 | * | 5/1989 | |
| DE | 39 40 583 A1 | * | 6/1991 | |

* cited by examiner

*Primary Examiner*—Stephen M. Johnson
(74) *Attorney, Agent, or Firm*—James M. Kasischke; Michael F. Oglo; Jean-Paul A. Nasser

(57) ABSTRACT

An apparatus for launching an object in a fluid environment having a tubular member with a forward muzzle end, an opposed rearward end. The object is positioned in the tubular member. Ends of the tubular member are closed by expellable members. Flood valves are located on the expellable members and, on activation, allow flooding of the tubular member by external fluid. A propellant device and an object contact member are disposed within the tubular member. When the propellant device is activated, the object contact member moves the object. These actions are controlled by a control device which first causes the flood valves to enable fluid to flood the interior region. Next, the control device causes the expellable members to be expelled from the tubular member. The control device then causes the propellant device to generate gas in a predetermined manner launching the object from the tubular member.

15 Claims, 3 Drawing Sheets

APPARATUS FOR LAUNCHING AN OBJECT IN A FLUID ENVIRONMENT

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention generally relates to an apparatus for launching an object in a fluid environment.

(2) Description of the Prior Art

Devices and systems for launching objects, weapons or vehicles into the ocean or other fluid or liquid environments are known in the art. For example, such devices are used to launch or eject buoys at relatively deep depths from a submerged submarine. Some of these devices and systems for launching objects are described in U.S. Pat. Nos. 3,476,048, 3,516,380, 4,185,345 and 5,918,307. One particular well known prior art system uses gas generators to launch objects underwater. One such system is described in U.S. Pat. No. 5,981,307 entitled "Underwater Projectile Launcher". U.S. Pat. No. 5,981,307 discloses that the launcher described therein can use any of the well known types of chemical energy storage—solid, liquid or gaseous propellants—for generating the gas required to launch the projectile.

Typically, many launching systems currently in operation utilize solid propellants. In such systems, the solid propellant is ignited and gas is generated from the burning propellant. This gas is used to effect the device launch. One significant problem with such systems is that the solid propellant is highly flammable and explosive and must be handled with great care. This problem creates additional cost and expense associated with handling and storage of the solid propellant, and significantly increases the time it takes to initiate and effect a safe and successful launch of an object.

What is needed is an apparatus for launching an object into a fluid environment that eliminates the aforementioned deficiencies of the prior art systems which utilize gas generation to launch an object into a fluid environment.

SUMMARY OF THE INVENTION

The present invention is directed to an apparatus for launching an object into a fluid environment such as oceans, rivers, lakes, or any fluid or liquid contained within any man-made structure or made-made earthen works. In one embodiment, the apparatus comprises a tubular member having a forward muzzle end and an opposed rearward end. The tubular member has a longitudinally extending axis, an interior region for receiving an object to be launched, an exterior wall confronting the fluid environment and an interior wall. The apparatus further includes expellable members for closing the forward muzzle end and rearward end of the tubular member, at least one flood valve member located on a corresponding expellable member for enabling fluid confronting the exterior wall to flood the interior region so as to equalize forces on the interior and exterior walls of the tubular member, and an object contact member disposed within the interior region and movable along the longitudinally extending axis. The object contact member contacts and moves the object when a propelling force is applied to the object contact member. The apparatus further includes a propellant device for producing the propelling force. The device contains a gas generator and is configured to generate gas in controlled amounts that are sufficient to propel the object contact member in the direction of the forward muzzle end. The apparatus further includes a control device that controls the flood valve member, the expellable members and the propellant device in accordance with a predetermined timed sequence wherein the control device first controls the flood valve to allow fluid to flood the interior region. Thereafter, the control device causes the expellable members to be expelled from the forward muzzle end and rearward end. Thereafter, the control device controls the propellant device to release generated gas in successive bursts so as to produce a continuous propelling force that causes the object contact member to propel the object through the tubular member, out through the forward end muzzle and into the fluid surrounding the tubular member. The successive bursts of generated gas are preferably uniform, continuous and stable thereby resulting in a fully stable ejection of the object at a relatively high exit velocity.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT

In describing the preferred embodiments of the present invention, reference will be made herein to FIGS. 1–3 of the drawings in which like numerals refer to like features of the invention.

Figure 1:
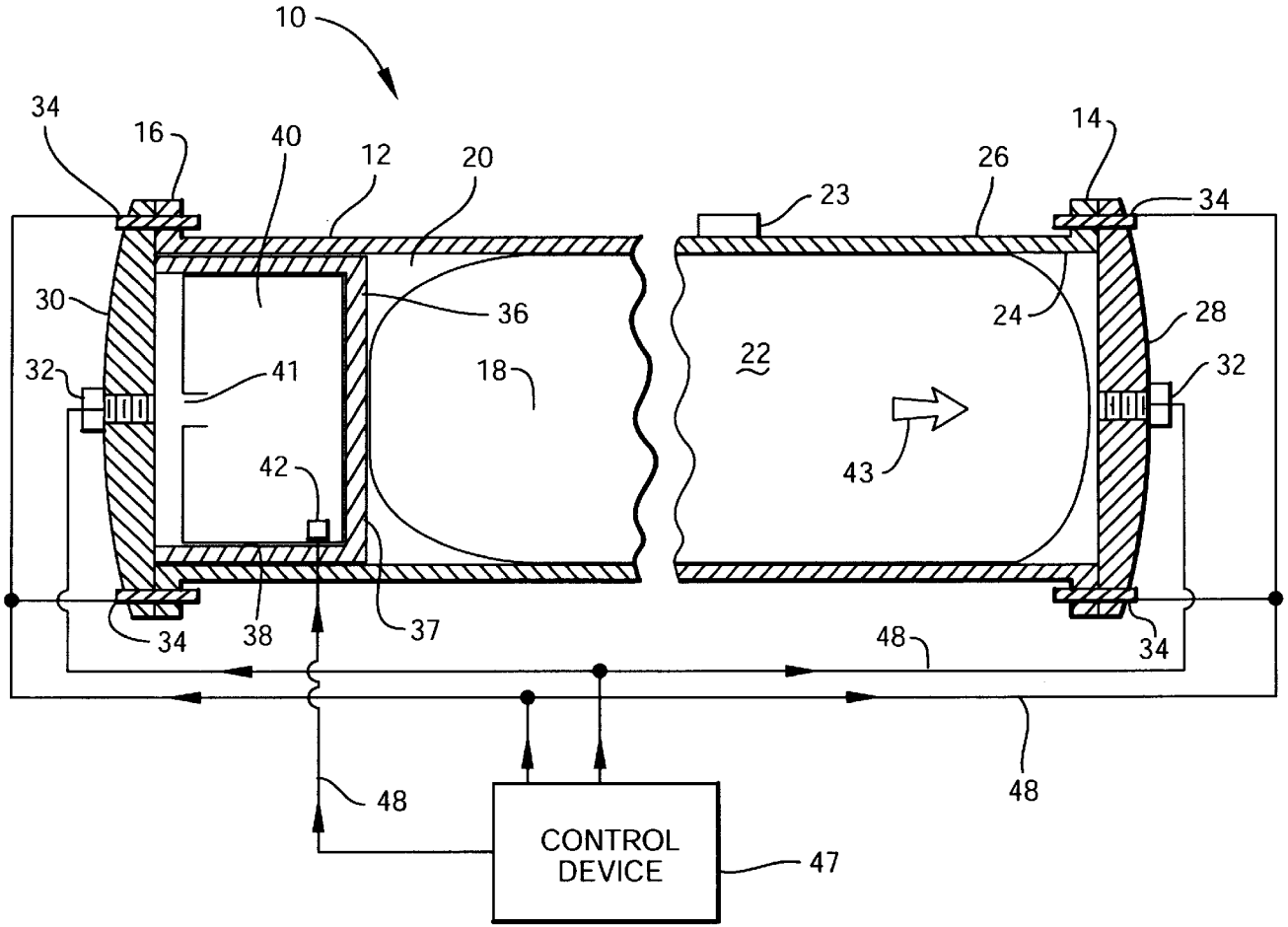
FIG. 1 is a combination side-elevational view, partially in cross-section, and schematic diagram of the apparatus of the present invention.

Referring to FIG. 1, there is shown apparatus 10 of the present invention. Apparatus 10 generally comprises tubular member 12 which has forward muzzle end 14 and opposed rearward end 16. Tubular member 12 has longitudinally extending axis 18 and interior region 20 for receiving object 22 (e.g. vehicle, torpedo, weapon, buoy, hydroplane, etc.) that is to be launched into the fluid environment surrounding apparatus 10. Tubular member 12 can be made from any rigid material including metals, composites and plastics. As used herein, the term "fluid environment" includes oceans, rivers, lakes, or any body of fluid or liquid contained within any man-made structure or made-made earthen works. In one embodiment, tubular member 12 comprises a barrel. Such a barrel is described in U.S. Pat. No. 5,918,307. Apparatus 10 includes clamping device 23 that allows tubular member 12 to be attached to the hull of a vessel such as a ship, submarine or any other vessel or device that travels through such a fluid environment. In one embodiment, clamping device 23 is configured to allow tubular member 12 to be releasably attached to the vessel. Such a configuration enables tubular member 12 to be released from the vessel after object 22 is launched.

Referring to FIG. 1, tubular member 12 has interior wall 24 and exterior wall 26 confronting the fluid environment. Apparatus 10 includes a muzzle expellable member 28 and breech expellable member 30 for closing the forward muzzle end 14 and opposed rearward end 16 of tubular member 12.

Referring to FIG. 1, apparatus 10 further comprises flood valve members 32 for enabling fluid external to tubular member 12 to flood interior region 20 in a controlled manner so as to minimize water hammer effects, especially at relatively deep depths. One flood valve member 32 is located on expellable member 28. The other flood valve member 32 is located on expellable member 30. Although the foregoing description is in terms of two flood valves 32, it is to be understood that apparatus 10 can utilize just one flood valve 32 or more than two flood valves 32. Flood valve or valves 32 can be positioned on tubular member 12 in an alternate embodiment. In a preferred embodiment, each flood valve 32 comprises an exploding valve that is exploded upon receipt of an electrical control signal. Once flood valve 32 explodes, fluid enters interior region 20.

Apparatus 10 includes a plurality of exploding bolts 34 for attaching muzzle expellable member 28 to the forward muzzle end 14 and breech expellable member 30 to the opposed rearward end 16. Exploding bolts 34 are exploded upon receipt of an electrical control signal. Explosion of bolts 32 propels expellable members 28 and 30 away from tubular member 12.

Referring to FIG. 1, apparatus 10 further comprises object contact member 36 disposed within interior region 20 and movable along longitudinally extending axis 18. Object contact member 36 contacts at contact surface 37 and moves object 22 when a propelling force is applied to the object contact member 36. In one embodiment, object contact member 36 is generally cylindrical in shape and defines an interior space 38. In a preferred embodiment, object contact member 36 comprises a sabot.

In an alternate embodiment of apparatus 10, tubular member 12 includes a rail (not shown) that longitudinally extends within interior region 20. In such an embodiment, object contact member 36 is movably mounted on the rail.

As shown in FIG. 1, apparatus 10 further includes propellant device 40 for producing a propelling force. Propellant device 40 is disposed within interior space 38 of object contact member 36. Device 40 produces a propelling force that propels object contact member 36. In accordance with the present invention, propellant device 40 is a plurality of chemical or hybrid gas generators and is configured to release generated gas via exit or exhaust opening 41 in controlled amounts that are sufficient to propel object contact member 36. Device 40 includes an electrical interface 42 that is configured to receive an electrical control signal that effects generation of the gas. The propelling force resulting from the release of the gas propels object contact member 36 and object 22 in the direction indicated by arrow 43 and toward forward muzzle end 14. Prior to the generation of gas from device 40, object contact member 36 is positioned so that device 40 is located near opposed rearward end 16.

Figure 2:
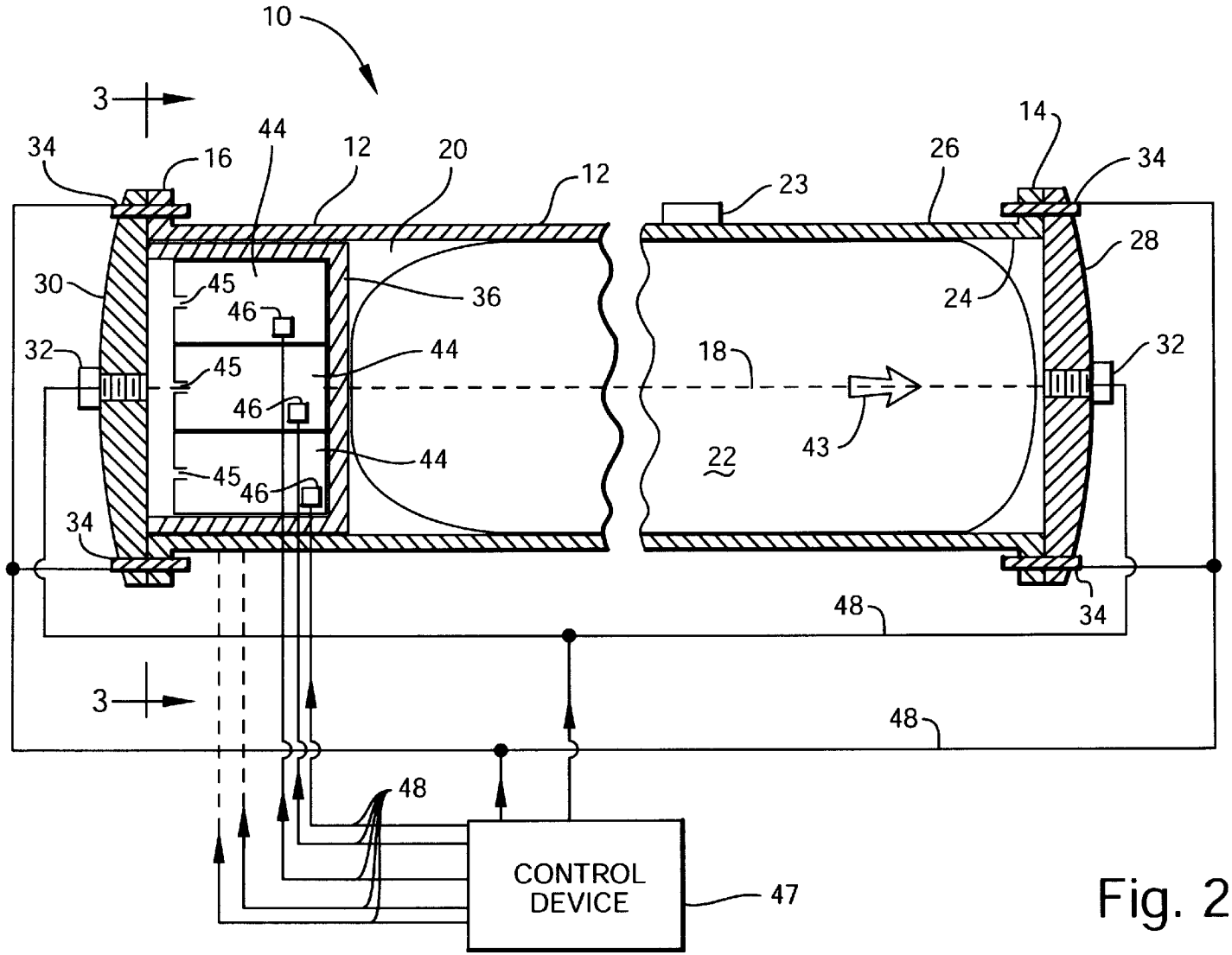
FIG. 2 is a combination side-elevational view, partially in cross-section, and schematic diagram of one embodiment of the apparatus of the present invention.
Figure 3:
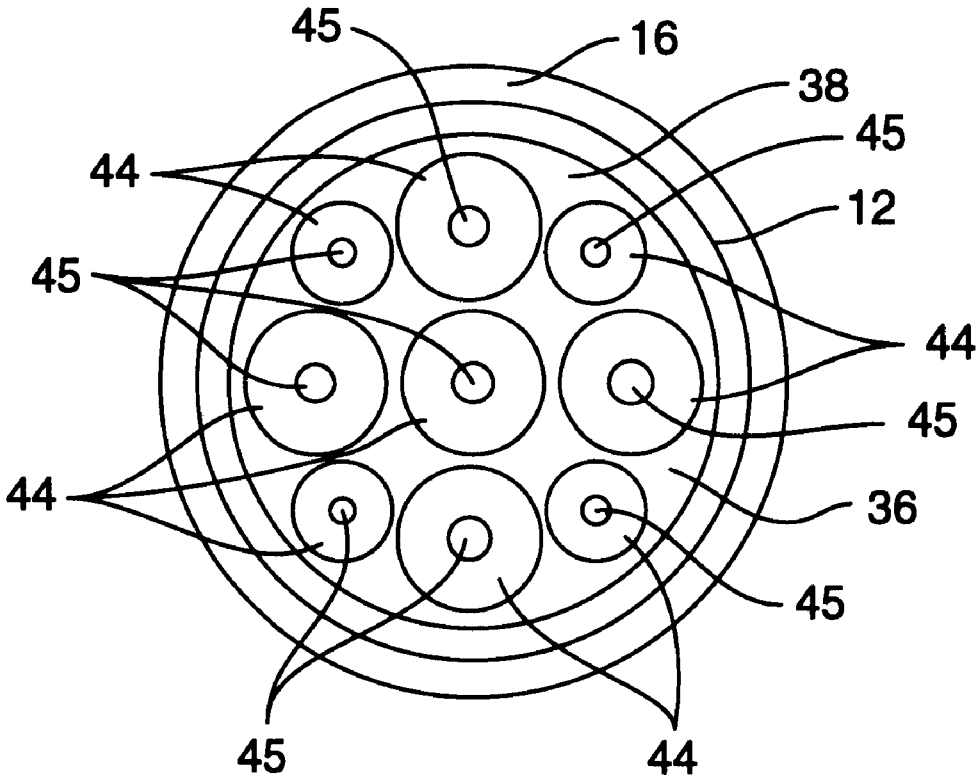
FIG. 3 is a view taken along line 3—3 in FIG. 2.

Referring to FIGS. 2 and 3, in one embodiment, gas generator device 40 comprises a plurality of chemical gas generators 44 wherein each gas generator 44 can generate a predetermined amount of gas that is emitted from exit or exhaust opening 45 of each device 44. Gas generators 44 can be chemical gas generators or hybrid gas generators incorporating a chemical gas generator with compressed gas. Compressed gas, in standard packaging, does not have sufficient energy density to effect a launch. Each generator 44 includes an electrical interface 46 for receiving an electrical control signal that effects generation of the gas in the corresponding gas generator device 44. As shown in FIG. 2, exit 45 of each device 44 faces breech expellable member 30. Referring to FIG. 3, in a preferred embodiment, the plurality of gas generators 44 are symmetrically arranged. In one embodiment, each gas generator 44 comprises a canister containing a gas generating compound or a gas generating compound and a compressed gas as is well known in the art of automobile airbag inflation devices. For the purpose of simplicity, wires 48 are not, shown in FIG. 3.

Referring to FIG. 1, apparatus 10 further comprises control device 47. Control device 47 is preferably located on board the vessel, ship or other device to which tubular member 12 is attached. Control device 47 contains electrical circuitry and electronic components that generate electrical signals that are transferred by wires 48 to explosive bolts 34, explosive flood valves 32, and interface 42 of device 40. Control device 47 is configured so the electrical signals are generated in a predetermined order and are separated by a predetermined time duration. In such a configuration, control device 47 first produces electrical signals that cause explosive valves 32 to is flood interior region 20 so as to equalize the pressures on interior wall 24 and exterior wall 26 of the tubular member 12. After a predetermined amount of time has elapsed which is sufficient to allow interior region 20 to completely flood, control device 47 outputs electrical signals that cause explosion of explosive bolts 34 so as to expel expellable members 28 and 30 from forward muzzle end 14 and opposed rearward end 16, respectively. After a predetermined amount of time has elapsed which is sufficient to allow expellable members 28 and 30 to fall away from tubular member 12, control device 47 outputs electrical signals to interface 46 of device 40 to enable device 40 to generate gas in successive bursts so as to produce a continuous propelling force that is applied to object contact member 36. As a result, object contact member 36 propels object 22 through tubular member 12 and out through forward muzzle end 14. If device 40 is comprised of the plurality of gas generators 44 as shown in FIGS. 2 and 3, then wires 48 are connected to each electrical interface 46 of each gas generator 44. In such a configuration, control device 44 generates electrical signals in a predetermined timed sequence so that each gas generator 44 generates gas in accordance with the predetermined timed sequence. In one embodiment, the predetermined timed sequence effects generation of gas from each gas generator 44 in a sequential order.

The gas generators 44 produce sufficient thrust to create a continuous, even, and stable ejection force during the entire launch of object 22 and causes object 22 to have a relatively high exit velocity as it exits tubular member 12. Since expellable member 30 is expelled from tubular member 12 before the compressed gas is released, the full thrust produced by the released gas is utilized to accelerate object 22 during launch without any thrust being used to overcome sea pressure. Thus, the plurality of gas generators 44 located within interior space 38 of object contact member 36 in conjunction with the predetermined time sequence in which each generator 44 generates its gas results in a full-power stroke ejection of object 22.

If control device 47 is located on board the vessel or ship, then clamping means 23 is configured to include an electrical interface that is electrically connected to wires 48.

The present invention provides many other benefits and advantages. Specifically, apparatus 10 reduces the danger associated with explosive solid and liquid propellants. Furthermore, the design of apparatus 10 is relatively less complex than prior art systems and, therefore, can be implemented at relatively lower costs and with commercially available components. Additionally, apparatus 10 provides a consistent, continuous and even propelling force that is applied to the object during the entire launch process thereby resulting in a full-stroke ejection of the object. Apparatus 10 also provides for relatively high exit velocity of the object as it leaves tubular member 12. Apparatus 10 eliminates any impact related to varying sea pressures (or ship depths).

Although foregoing description is in terms of apparatus 10 being used in a fluid environment, it is to be understood that apparatus 10 can be used in gaseous environment wherein object 22 is launched in the gaseous environment.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An apparatus for launching an object in a fluid environment, comprising:

a tubular member having a forward muzzle end and an opposed rearward end, the tubular member having a longitudinally extending axis, an exterior wall confronting the fluid environment and an interior wall defining an interior region for receiving an object to be launched;

a muzzle expellable member closing the forward muzzle end of the tubular member;

a breech expellable member closing the rearward end of the tubular member;

at least one flood valve member enabling environmental fluid to flood the interior region so as to equalize pressure between the interior and exterior walls of the tubular member;

an object contact member slidably disposed within the tubular member interior region and movable along the longitudinally extending axis, the object contact member contacting and moving the object;

a propellant device disposed in said tubular member between the breech expellable member and the object contact member, the propellant device being configured to produce gas in successive bursts that are sufficient to propel the object contact member in the direction of the forward muzzle end; and a control device joined to the flood valve member, the expellable members and the propellant device.

2. The apparatus according to claim 1 wherein:

the control device first causes the flood valve member to allow fluid to flood the tubular member interior region, the control device next causing the muzzle expellable member and breech expellable member to be expelled from the tubular member, and the control device causing the propellant device to produce the gas in a preprogrammed manner; and the propellant device is configured to produce the gas in accordance with the preprogrammed manner.

3. The apparatus according to claim 1 wherein the propellant device comprises a plurality of gas generators, each gas generator producing a predetermined amount of gas.

4. The apparatus according to claim 3 wherein the plurality of gas generators are symmetrically arranged.

5. The apparatus according to claim 3 wherein each gas generator comprises a selected one of a chemical generating a gas and a combination of a chemical generating a gas with a compressed gas.

6. The apparatus according to claim 2 wherein:

the propellant device comprises a plurality of gas generators, each gas generator producing a predetermined amount of gas; and the control device is configured to control the plurality of gas generators in a manner such that each gas generator produces gas therein in accordance with the preprogrammed manner.

7. The apparatus according to claim 6 wherein the predetermined timed sequence effects production of the gas of each gas generator in a sequential manner.

8. The apparatus according to claim 1 wherein the object contact member is generally cylindrical in shape and defines an interior space.

9. The apparatus according to claim 8 wherein the propellant device is disposed within the interior space of the object contact member.

10. The apparatus according claim 1 wherein the object contact member slides out of the tubular member after the object is launched.

11. The apparatus according to claim 1 wherein the muzzle expellable member is attached to the forward muzzle end and the breech expellable member is attached to the rearward end, the apparatus further comprising a plurality of exploding bolts for attaching the muzzle expellable member to the forward muzzle end and the breech expellable member to the rearward end.

12. The apparatus according to claim 1 wherein the at least one valve member comprises a pair of valve members, one valve member being located on the muzzle expellable member, the other valve member being located on the breech expellable member.

13. The apparatus according to claim 1 wherein the at least one valve member comprises an exploding valve.

14. The apparatus according to claim 1 further comprising means for attaching the tubular member to a vessel.

15. The apparatus according to claim 14 wherein the attaching means comprises means for releasing the tubular member from the vessel.

* * * * *